United States Patent [19]

Winquist

[11] Patent Number: 4,984,738

[45] Date of Patent: Jan. 15, 1991

[54] UNIT INJECTOR FOR STAGED INJECTION

[75] Inventor: Knut L. Winquist, San Antonio, Tex.

[73] Assignee: Association of American Railroads, Washington, D.C.

[21] Appl. No.: 777,347

[22] Filed: Sep. 18, 1985

[51] Int. Cl.[5] ..... F02M 45/08; F02M 57/02

[52] U.S. Cl. ..... 239/88; 137/627; 137/881; 239/90; 239/95

[58] Field of Search ..... 137/627 X, 637.2, 881 X; 239/88–92, 95, 553.1–553.12, 452, 453

[56] References Cited

U.S. PATENT DOCUMENTS

| | | | |
|---|---|---|---|
| 1,852,191 | 4/1932 | Salisbury | 239/88 |
| 2,317,618 | 4/1943 | King | 239/533.7 X |
| 2,552,776 | 5/1951 | French | 239/87 |
| 2,898,051 | 8/1959 | Teichert | 239/88 X |
| 3,339,848 | 9/1967 | Geiger | 239/533.4 X |
| 3,982,693 | 9/1976 | Hulsing | 239/88 |
| 4,187,825 | 2/1980 | Loyd, Jr. | 239/533.3 |
| 4,202,500 | 5/1980 | Keiczek | 239/533.3 |
| 4,215,821 | 8/1980 | Eblen | 239/533.8 X |
| 4,317,541 | 3/1982 | Beardmore | 237/533.3 |
| 4,394,970 | 7/1983 | Hofmann et al. | 239/533.7 X |
| 4,565,320 | 1/1986 | Taniguchi et al. | 239/88 |
| 4,598,867 | 7/1986 | Trachte | 239/453 |

FOREIGN PATENT DOCUMENTS

| | | | |
|---|---|---|---|
| 101791 | 8/1937 | Australia | 239/87 |

OTHER PUBLICATIONS

"Fuel Injection and Controls" Paul G. Burman, Frank DeLuca, pp. 29, 30, 68–70, 1962.

"Expanding Diesel Engine Cetane Limits Through Staged Injection", Quentin A. Baker, SAW Technical Publication 830,246, 1985.

*Primary Examiner*—Andres Kashnikow

*Attorney, Agent, or Firm*—Antonelli, Terry, Stout & Kraus

[57] ABSTRACT

A unit injector for staged injection of fuel in an internal combustion engine is disclosed. The unit injector comprises a fuel pump and a spray nozzle combined in a single unit adapted to be mounted on the engine with the fuel pump adapted to be driven by a mechanism provided on the engine. The fuel pump of the unit injector includes a pair of cooperating plungers defining first and second fuel compression chambers for producing a plurality of discrete fuel injections during a single cycle of the internal combustion engine and with a single stroke of the driven plunger of the fuel pump.

6 Claims, 2 Drawing Sheets

UNIT INJECTOR FOR STAGED INJECTION

BACKGROUND AND SUMMARY OF THE INVENTION

The present invention is directed to an improved unit injector for injecting fuel in an internal combustion engine. More particularly, the invention is directed to an improved unit injector which is capable of producing staged injection of fuel in the internal combustion engine.

Unit injectors, per se, are known. They are characterized by the combination of a pump such as a jerk type pump and a spray nozzle in a single unit, which is adapted to be mounted on the engine, e.g., on the cylinder head. This design eliminates the problems of pressure waves and fuel compressibility in long discharge tubings, but it requires that means be provided on the engine for actuating the injectors. For example, the pump plunger follower can be depressed by a roller at the end of a cam actuated rocker provided on the engine and returned by a follower spring. The unit injector as it is known, however, does not have the capability to produce staged injection, that is, two or more discrete fuel injections during a single stroke of the internal combustion engine.

Thus, an object of the present invention is to provide an improved unit injector which overcomes the aforementioned disadvantage of the known unit injectors. More particularly, an object of the invention is to provide an improved unit injector which is capable of producing a plurality of discrete fuel injections during a single cycle of the internal combustion engine so that staged injection can be accomplished.

The advantages that are achieved by utilizing a staged injection technique are described in the SAE Technical Paper No. 830246. In short, staged injection involving the injection of a small portion of the fuel early in the cycle to act as a pilot for a main fuel charge injected later in the cycle expands the diesel engine cetane limits. As reported in the aforementioned paper, where both pilot and main charges were the same fuel, knocking was eliminated on fuels with cetane numbers as low as 17 at the standard 16:1 compression ratio.

The aforementioned and other objects of the present invention are attained by providing a unit injector according to the invention for injecting fuel in an internal combustion engine. The unit injector comprises a fuel pump and a spray nozzle combined in a single unit adapted to be mounted on the engine with the fuel pump adapted to be driven by a mechanism provided on the engine, and wherein the improvement comprises providing means in said unit injector for producing a plurality of discrete fuel injections during a single cycle of the internal combustion engine.

According to a further feature of the present invention, the unit injector includes means for discharging respective ones of the plurality of discrete fuel injections from different discharge orifices of a plurality of discharge orifices provided in the spray nozzle of the unit injector. The means for discharging respective ones of the plurality of discrete fuel injections from different discharge orifices of the plurality of discharge orifices in the spray nozzle includes a plurality of valves which respectively open the different discharge orifices of the spray nozzle for injection of the plurality of discrete fuel injections.

In the disclosed embodiment, the plurality of valves include first and second needle valves arranged in telescoping relation. First and second biasing means are provided for respectively resiliently biasing the first and second needle valves in positions to close respective one of the different discharge orifices in the spray nozzle. Fuel passage means are provided in the unit injector for delivering fuel from the fuel pump to the spray nozzle. First and second pressure chambers are provided around respective portions of the first and second needle valves. The first and second pressure chambers are in fluid communication with the fuel passage means so that fuel from the fuel passage means can be supplied to the pressure chambers for moving the respective valves against the biases of the first and second biasing means to open the discharge orifices for fuel injection. The magnitudes of the resilient biasing forces of the first and second biasing means are selected so that their forces correspond to different fuel pressures of, for instance, 4000 psi and 2000 psi, respectively. With such an arrangement, only the second or pilot valve will open when fuel is delivered from a second or pilot compression chamber of the fuel pump at the lower pressure of 2000 psi and only the first or main valve will open when the fuel is delivered from a first or main compression chamber of the fuel pump at the higher pressure of 4000 psi.

More particularly, the fuel pump of the unit injector comprises means defining a first relatively large diameter cylinder. A first relatively large diameter piston or plunger is positioned at least partially within the first cylinder and is adapted to be driven along the longitudinal axis of the cylinder by a conventional mechanism provided on the engine for pumping the fuel. An end of the first plunger within the first cylinder defines an end of a first or main fuel compression chamber of the fuel pump within the first cylinder. The end of the first plunger also has a second relatively small diameter cylinder formed therein. A second relatively small diameter plunger extends through the first fuel compression chamber and into the second cylinder for relative movement in the second cylinder as the first plunger is driven by the mechanism. An end of the second plunger within the second cylinder defines an end of a second or pilot fuel compression chamber of the pump within the second cylinder. Fuel inlet and outlet passage means are provided for conveying fuel to and from the first and second fuel compression chambers. The inlet and outlet passage means are arranged so as to be opened and closed by the first plunger during its movement in the first cylinder and relative to the second plunger for producing discrete fuel injections from the first and second fuel compression chambers during a single stroke of the first plunger. The two discrete fuel injections from the first and second fuel compression chambers, respectively, each occur at a predetermined time and are of a predetermined duration depending upon the arrangement of the inlet and outlet passage means.

The outlet passage means for the second or pilot fuel compression chamber includes a bore extending through the second plunger. The second plunger is provided with a flange at an end thereof located outside of the second cylinder. The flange defines an end of the first or main fuel compression chamber. The outlet passage means for the first or main fuel compression chamber includes a bore formed in the flange of the second plunger.

The outlet passage means from each of the first and second compression chambers is in fluid communication with the fluid passage means for delivering fuel from the fuel pump to the spray nozzle. Check valve means are provided in each of the outlet passage means to prevent fuel flow into the fuel compression chambers from the outlet passage means during the injections of fuel from the respective fuel compression chambers of the fuel pump.

These and other objects, features and advantages of the present invention will become apparent from the following description when taken in connection with the accompanying drawings which show, for purposes of illustration only, one embodiment in accordance with the present invention.

DESCRIPTION OF THE PREFERRED EMBODIMENT

Figure 1:
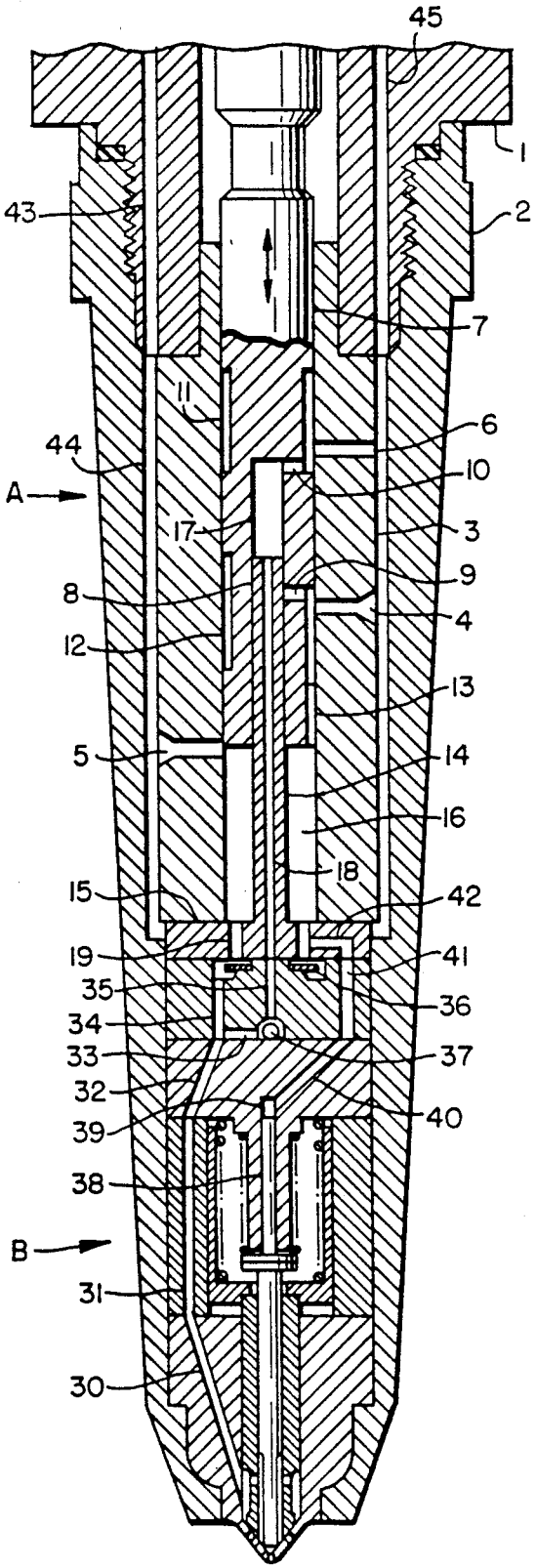
FIG. 1 is a cross-sectional view of a preferred embodiment of the unit injector of the invention taken through the longitudinal axis of the unit injector.
Figure 11:
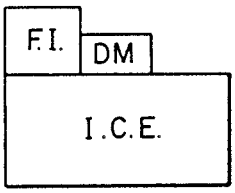
FIG. 11 is a schematic view of the arrangement of the internal combustion engine, fuel injector and drive mechanism therefor.
Figure 2:
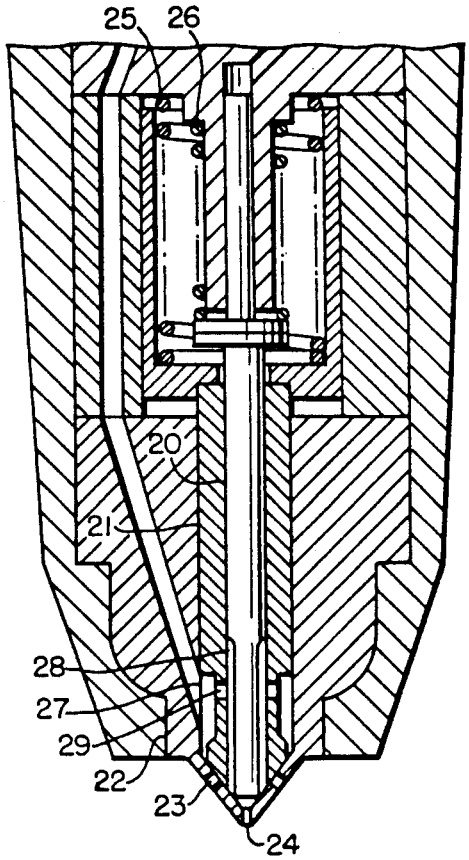
FIG. 2 is an enlarged cross-sectional view of a portion of the injector nozzle of the unit injector shown in FIG. 1.

Referring now to the drawings, the unit injector as shown in FIG. 1 is applied to a holder 1 of a conventional unit injector, of which only the lower part is shown. By means of a tubular member 2 the components of the invention are fastened to the holder 1. The components comprise a fuel pump A and a spray nozzle B. The fuel pump A comprises a cylindrical barrel 3 with radial ports 4, 5, and 6, a first or primary plunger 7 that has a cylindrical cavity 8, radial ports 9 and 10, annular grooves 11 and 12, and a longitudinal slot 13. Protruding into the cavity of the primary plunger is a secondary plunger 14 that has a flange 15 by which a first or main compression chamber 16 is enclosed within the barrel 3 between the flange 15 and the primary plunger 7. A second or pilot compression chamber 17 is formed between the end of the cavity 8 and the secondary plunger 14. Outlet from the chamber 17 is arranged by a central bore 18 and outlets from the chamber 16 are formed by apertures 19 in the flange 15.

The spray nozzle B in the lower part of the unit injector includes two telescoping needle valves, namely, an inner pilot valve 20 and an outer main valve 21. The valves are seated on the lower end of a nozzle tip 22 above main orifices 23 and a pilot orifice 24 and are urged toward the nozzle tip by a main spring 25 and a pilot spring 26, respectively. Around the lower portions of the needle valves are pressure chambers 27 and 28 arranged so that when they are sufficiently pressurized the valves will open the passage to the orifices of the nozzle tip.

The pilot pressure chamber 28 communicates with the main pressure chamber 27 through the holes 29 in the lower portion of the main valve 21 and both pressure chambers communicate with the outlets 18 and 19 of the double acting pump through fuel passage means defined by channels 30, 31, 32, 33, 34 and 35. An annular shaped check valve 36 prevents backflow of fuel into the main compression chamber 16 and a ball shaped check valve 37 prevents backflow of fuel into the pilot compression chamber 17.

The upper portion of the pilot valve 20 is confined within a sleeve 38. The upper end of the bore 39 in the sleeve communicates with the main compression chamber 16 via channels 40, 41 and 42. The cross-sectional area of the upper part of the pilot valve 20 is larger than the differential area, by which the pressure chamber 28 was created, at its lower portion. Hence, when fuel in the compression chamber 16 is pressurized, this fuel pressure, being transferred to the pressure chamber 28 via the communicating channels 32, 31, 30, will urge the pilot valve 20 toward the open position but the pilot valve 20 will remain closed because the same fuel pressure is acting on the upper end of the valve urging it toward closed position with a stronger force.

During operation of the unit injector, as explained more fully below, the two pressure chambers of the pump are never pressurized at the same time. When the fuel in the pilot compression chamber 17 is pressurized, this pressure is transferred through channels 18, 33, 32, 31 and 30 to pressure chambers 27, 28 which communicate through holes 29. When the fuel pressure is sufficient to overcome the downward force by the spring 26, the pilot valve 20 will open. The main valve 21, however, will remain closed because the spring 25 is chosen so that a still higher fuel pressure is needed in order to overcome its downward force.

The two springs 25 and 26 may be matched in that their forces correspond to fuel pressures of, for example, 4000 psi and 2000 psi, respectively. In this way only the pilot valve 20 will open when fuel is delivered from the pilot compression chamber 17 at a pressure of 2000 psi and only the main valve 21 will open when the fuel is delivered from the main compression chamber 16 at a pressure of 4000 psi.

The first or primary plunger 7 of the fuel pump A of the injector unit as shown in FIG. 1 is a reciprocating plunger which is driven by a conventional mechanism not shown on the drawing. For example, a roller at the end of a cam actuated rocker can be used to depress a pump plunger follower provided in contact with the plunger 7 thereby depressing the plunger 7 with the pump plunger follower being returned by a follower spring during the upper movement of the reciprocation rocker. Fuel is supplied by a fuel delivery system through an inlet, not shown, in the holder 1 and enters the pump through a channel 43 and flows to an annular space 44 encompassing the barrel 3. Excessive fuel is returned through a channel 45 and an outlet not shown. The plunger, as shown in FIG. 1, has been moved partly downward from its uppermost position. FIGS. 3 through 10 show several positions of the plunger between the start and the end of a pumping stroke which is effected within a single cycle of the diesel engine cylinder in which the fuel is injected by the injector.

Figure 3:
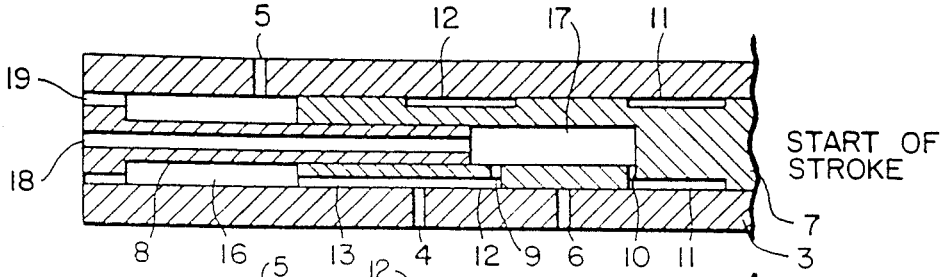
FIGS. 3 through 10 are illustrations of the two pump plungers and cylinder barrel of the fuel pump showing how the inlets and outlets of the fuel pump are opened and closed as the first relatively large diameter plunger moves from its upward position as shown in FIG. 1 to its lower position.
Figure 4:
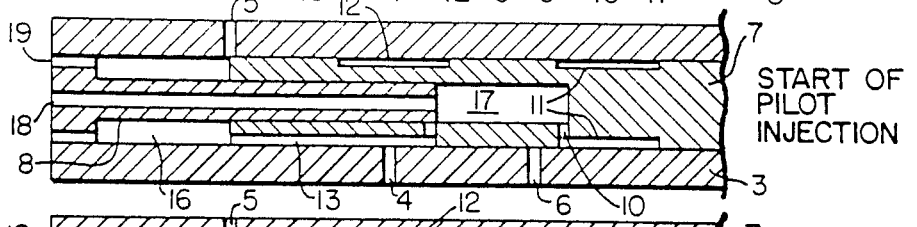
Figure 5:
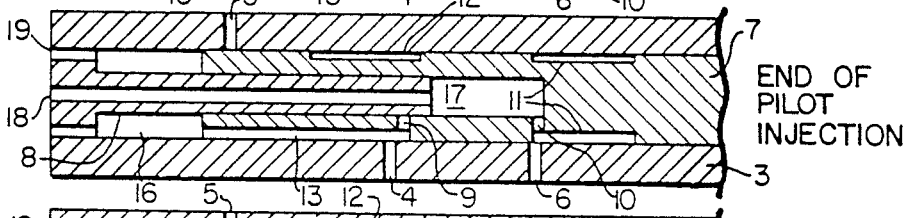

More specifically, FIG. 3 shows that at the start, i.e., the uppermost position of the plunger as seen in FIG. 1, fuel may enter through port 5 into the main chamber 16 and flow through the slot 13, the groove 12, and port 9 into the pilot chamber 17. The fuel is returned through the port 4. In FIG. 4 the plunger has moved to the position where the port 9 is closed by the secondary plunger, and as the plunger moves further toward the position shown in FIG. 5, the fuel in the pilot compression chamber 17 is pressurized and a pilot injection will occur at a pressure of 2000 psi, for example, as described above. In FIGS. 4 and 5 it can be seen that as the plunger approaches the position of FIG. 5, the port 5 is being closed. However, the fuel in the main compression chamber will not be pressurized because of the open connection with port 4 through the slot 13 and the groove 12.

Figure 6:
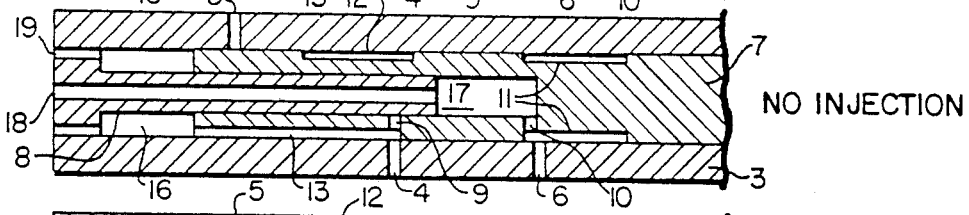
Figure 7:
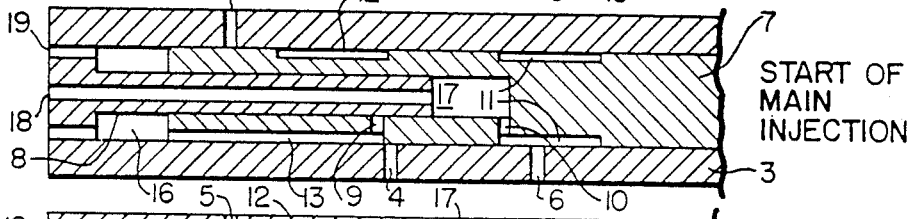
Figure 8:
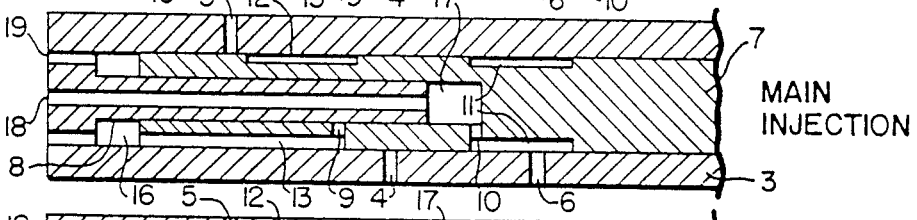
Figure 9:
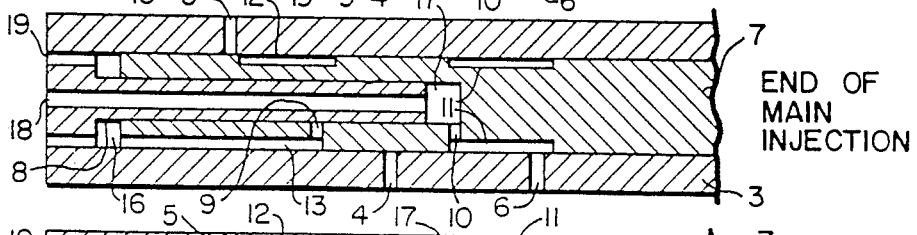
Figure 10:
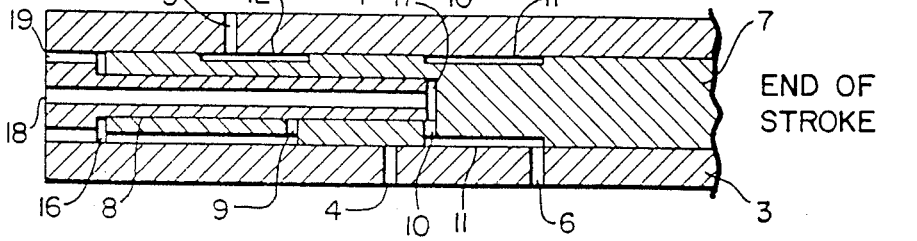

In FIG. 6 it is shown that no injection occurs as the plunger continues moving after the end of the pilot injection because the main compression chamber is still connected to the port 4. The pilot injection is ended when the pilot compression chamber becomes connected to port 6 through the port 10 and the groove 11. In FIG. 7 the plunger has moved to the position where the port 4 is closed, with the result that the main compression chamber will be pressurized as the plunger is moved further as shown in FIG. 8. The main injection will occur while the plunger is moving from the position of FIG. 7 to the position of FIG. 9. As the plunger is moving beyond this position toward the end of the stroke, as shown in FIG. 10, the main compression chamber is connected to the port 5 through the slot 13 and the annular groove 12.

The timing and duration of the pilot and main injections of the unit injector of the invention can be predetermined by matching the speed of the movement of the plunger 7, location of the ports and shape of the annular grooves (helixes) according to known technique as described, for instance, in the book *Fuel Injection Controls* by Burman and DeLuca, Chapter 6, which is hereby incorporated by reference.

The unit injector of the invention has the distinct advantage as compared with known unit injectors of being able to produce two discrete fuel injections during a single cycle of the internal combustion engine and a single stroke of the fuel pump plunger. This permits staged injection as referred to above thereby expanding the cetane limits of a diesel engine, for example. The novel unit injector of the invention is also advantageous in that it can be built into a compact unit that can easily replace an existing conventional injector on an engine without any change of the cylinder head of the engine.

While I have shown and described one embodiment in accordance with the present invention, it is understood that the same is not limited thereto, but is susceptible of numerous changes and modifications as would be known to those skilled in the art, given the present disclosure. Thus, I do not wish to be limited to the details shown and described, but intend to cover all such changes and modifications as are encompassed by the scope of the appended claims.

I claim:

1. A unit injector for injecting fuel in an internal combustion engine, said unit injector comprising a fuel pump and a spray nozzle combined in a single unit adapted to be mounted on said engine with said fuel pump being adapted to be driven by a mechanism provided on said engine, the improvement comprising means for producing a plurality of discrete fuel injections during a single stroke of said internal combustion engine, said fuel pump comprising means defining a first relatively large diameter cylinder, a first relatively large diameter plunger positioned at least partially within said first cylinder and adapted to be driven along the longitudinal axis of said cylinder by said mechanism provided on said engine for pumping said fuel, an end of said first plunger within said first cylinder defining an end of a first fuel compression chamber of said pump within said first cylinder, said end of said first plunger having a second relatively small diameter cylinder formed therein, a second plunger extending through said first fuel compression chamber and into said second cylinder for relative movement in said second cylinder as said first plunger is driven by said mechanism, an end of said second plunger within said second cylinder defining an end of a second fuel compression chamber of said pump within said second cylinder, fuel inlet and outlet passage means for conveying fuel to and from said first and second fuel compression chambers, said inlet and outlet passage means being arranged to be opened and closed by the movement of said first plunger in said first cylinder and relative to said second plunger for producing discrete fuel injections from said first and second fuel compression chambers during a single stroke of said first cylinder.

2. A unit injector according to claim 1, wherein the outlet passage means for said second fuel compression chamber includes a bore extending through said second plunger.

3. A unit injector according to claim 1, wherein said second plunger includes a flange at an end of said plunger located outside of said second cylinder, said flange defining an end of said first fuel compression chamber.

4. A unit injector according to claim 3, wherein said outlet passage means for said first fuel compression chamber includes a bore formed in said flange of said second plunger.

5. A unit injector according to claim 1, wherein said outlet passage means from each of said first and second fuel compression chambers are in fluid communication with a common fuel passage means for delivering fuel from said fuel pump to said spray nozzle, check valve means being provided in each of said outlet passage means to prevent fuel flow into said fuel compression chambers from said outlet passage means during discrete discharges of fuel from respective ones of said fuel compression chambers.

6. A unit injector according to claim 1, wherein said inlet and outlet passage means include radial ports located in predetermined spaced relationship in said means defining the first cylinder and in said first plunger so that they are opened and closed by the movement of the first plunger in the first cylinder and relative to the second plunger for producing the discrete fuel injections from the first and second fuel compression chambers.

* * * * *